United States Patent [19]

Oren

[11] Patent Number: 4,635,801

[45] Date of Patent: Jan. 13, 1987

[54] DEVICE FOR HOLDING AND STORING ARTICLES

[76] Inventor: Meir Oren, 149 Salame Road, Tel Aviv, Jaffa, Israel

[21] Appl. No.: 579,659

[22] Filed: Feb. 13, 1984

Related U.S. Application Data

[63] Continuation of Ser. No. 495,427, May 17, 1983, abandoned.

[51] Int. Cl.[4] ..... A47F 7/00

[52] U.S. Cl. ..... 211/70.6; 211/94; 248/316.1

[58] Field of Search ..... 248/201, 490, 491, 316.7, 248/316.4, 231.8, 316.1, 297.2; 211/70.6, 70.7, 60.1, 94

[56] References Cited

U.S. PATENT DOCUMENTS

| | | | |
|---|---|---|---|
| 698,272 | 4/1902 | Glover | 248/313 X |
| 1,793,520 | 2/1931 | Siptrott | 248/316.7 X |
| 2,076,941 | 4/1937 | Farr | 248/316.7 X |
| 2,462,051 | 2/1949 | Starr | 248/316.7 X |
| 2,695,105 | 11/1954 | Mitchell | 211/94 X |
| 2,795,834 | 6/1957 | Szoke | 248/316.7 X |
| 2,942,830 | 6/1960 | Senay | 248/316.7 X |
| 3,305,100 | 2/1967 | Barbee | 211/60 |
| 3,325,129 | 6/1967 | Tinfow et al. | 248/297.2 |
| 3,404,785 | 10/1968 | Emary | 248/201 X |
| 3,515,284 | 6/1970 | Taylor | 211/60.1 |
| 4,163,537 | 8/1979 | Mourque | 248/297.2 X |
| 4,179,091 | 12/1979 | Bidney | 248/295.1 X |
| 4,413,379 | 11/1983 | Evans | 248/316.7 X |

FOREIGN PATENT DOCUMENTS

| | | | |
|---|---|---|---|
| 1049697 | 12/1953 | France | 211/70.6 |
| 315675 | 8/1956 | Switzerland | 211/70.6 |

*Primary Examiner*—J. Franklin Foss
*Assistant Examiner*—David L. Talbott
*Attorney, Agent, or Firm*—Toren, McGeady, Stanger, Goldberg & Kiel

[57] ABSTRACT

There is provided a device for holding and storing articles which comprises an elongated, ruler like member having a slot extending longitudinally in the ruler like member, one or more pairs of springy fingers being provided—the two fingers in a pair being distinct from one another and unconnected to each other—one end of each finger being bent off at a substantially right angle from the major extension of the finger, at least two of the fingers being affixed to the ruler like member by means of co-acting male and female screw members, the male screw member passing through the bent off end portion of a finger and the longitudinal slot.

8 Claims, 10 Drawing Figures

DEVICE FOR HOLDING AND STORING ARTICLES

The present patent application is a continuation of my application Ser. No. 495,427 of May 17, 1983, now abandoned and concerns certain improvements of the construction described in that application.

OBJECT OF THE INVENTION

It is the object of the present invention to provide a device for holding and storing articles which device is a further development of the one which constitutes the subject matter of my said earlier patent application. The said improved construction permits easier assembly and disassembly of the device, and easier adjusting of the device relative to the articles to be held therein.

SHORT SUMMARY OF DISCLOSURE

The new device comprises an elongated, ruler like member having a slot extending longitudinally in the said ruler like member, one or more pairs of springy fingers being provided—the two fingers in a pair being distinct from one another and unconnected to each other—one end of each finger being bent off at a substantially right angle from the major extension of the finger, at least two of the said fingers being affixed to the said ruler like member by means of co-acting male and female screw members, the male screw member passing through the said bent off end portion of a finger and the said longitudinal slot.

In a preferred and practical embodiment, the said fingers are made of flat inherently springy material, such as e.g. steel strips and are wavily or undulatingly curved. Alternatively the fingers may be made of round or otherwise profiled lengths of material.

In yet another preferred embodiment the female screw member is a plate shaped nut the two crossing axes whereof are of different length and the said elongated ruler like member has at its rear side two oppositely disposed flanges along the whole extension of the said elongated ruler like member.

According to a further preferred feature the springy fingers, made of steel strips, are of an across curved profile.

SHORT DESCRIPTION OF DRAWINGS

FIG. 1 is a frontal fractional view of the new device.

FIG. 1*a* is a section on line 1*a*—1*a* of FIG. 1.

FIG. 1*b* shows the female screw member used in the new device.

FIG. 2 is a frontal, fractional view of another embodiment of the new device.

FIG. 2*a* is a section on line 2*a*—2*a* of FIG. 2.

FIG. 3 is a frontal, fractional view of yet another embodiment of the new device.

FIG. 3*a* is a section on line 3*a*—3*a* of FIG. 3.

Figure 1:
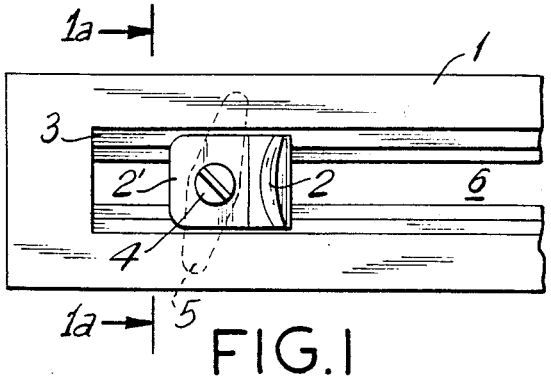
Figure 1A:
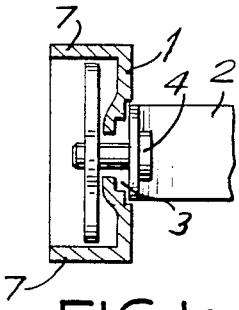
Figure 1B:
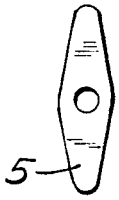

Turning first to FIGS. 1 and 1*a*, there is shown an elongated ruler like rail 1 being the base on which are provided springy fingers 2. These are set in a recess 3 in the frontal face of rail 1. As can be seen in FIGS. 1 and 1*a*, the recess 3 has stepped longitudinal side walls, hence in its wider, outer portion, wider finger 2 having wider bent off portions 2' may be accommodated, while in the inner, narrower portion of the recess narrower fingers can be placed. The fingers 2 are arranged in pairs, each pair serving as a holder for whatever article or commodity.

These fingers 2 may all be of the same size, but according to needs pairs of fingers 2 of different sizes and possibly of different shape may be provided.

The fingers 2 are affixed to the base 1 in a manner which permits easy mounting and dismounting of fingers 2 on the base and equally easy and quick adjusting the distance between the two fingers of a pair. The fingers 2 have a bent off portion 2' at one end (see also FIG. 4) in which is provided a hole 2''. A screw bolt 4 is inserted in hole 2'' whereupon a plate shaped nut 5 is screwed to the end of screw bolt 4. The nut is of a novel shape, it is an elongated plate 5 which is of larger extension lengthwise than it is crosswise. In the base 1 at the bottom of recess 3 is provided a lengthwise extending slot 6 which permits the passage of nut 5 if it is held to the slot 6 with its major axis extending co-directionally with slot 6. The sides of the recess 3 prevent the fingers 2 from turning about the bolt 4. At the rear side of base 1 it has two flanges 7 extending along both lengthwise edges of base 1. The nut 5 after having passed through slot 6 is positioned in the space between the two flanges 7, the major extension of nut 5 is greater that the distance between the two flanges 7. Thus with turning the screw bolt 4 the nut is taken along until its two ends (at the ends of its major axis) abut against the flanges 7, stopping further movement of the nut. As a result the screw bolt 4 can be screwed home until the nut 5 lies close to the inner side of base 1. In this way the respective finger 2 is securely attached to base 1. In order to adjust the distance between the two fingers the screw bolt 4 is released a little allowing free shifting of the finger in any direction in the slot. When the finger must be removed the nut is turned until its major axis extends co-directionally with slot 6 and then pulled out.

The type of rail forming the base 1 shown in FIGS. 1 and 1*a* will mainly—but not exclusively—be made of sheet metal by conventional stamping and punching operations. In this type of rail the "upper" and the "lower" run thereof are held together by end portions which extend across the extreme ends of slot 6.

Figure 2:
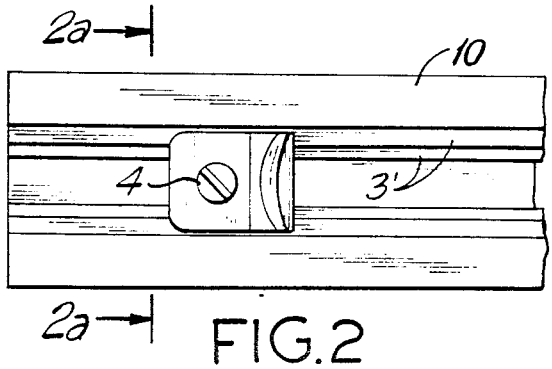

Contrarily the rail 10 of FIG. 2 is a metal or plastics profile, conventionally produced by extrusion processes. Here the "upper" and "lower" run are held together by a closed, box like portion 7' at the rear of rail 10, the lateral walls of the box constituting an equivalent of flanges 7 referred to above.

Figure 2A:
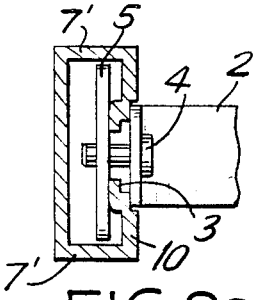

The springy fingers 2 and their manner of being affixed to the base is identical with what has been described. The nut 5, in this case is positioned in the box like portion 7' and is held in the manner described above. As can be seen in FIG. 2*a*, there is provided a recess 3' with stepped side walls, as already described. The bent off portion 2' of fingers 2 is positioned in one portion of the recess 3 at the front of the base 1.

Figure 3:
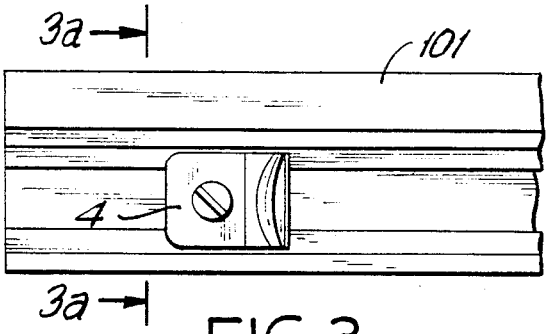
Figure 3A:
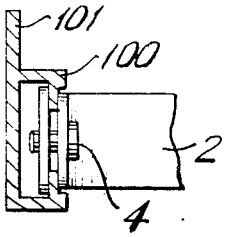

In the embodiment of FIG. 3 the rear part of rail 100 has an extension 101 onto which identification labels—for instance—may be stuck.

Figure 4:
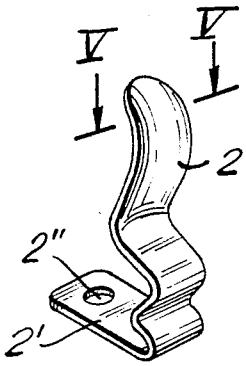
FIG. 4 is a perspective view of one of the springy fingers used in the new device.

The springy fingers 2—as shown in FIG. 4—are made of inherently, hard springy material (such as steel) and are preferably undulating, as shown in FIG. 4. The undulating of the fingers, gives it maximum flexibility to ease the insertion of tools or any other item inbetween two fingers and to avoid stress to the fingers.

Figure 5:
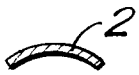
FIG. 5 is a section on line V—V of FIG. 4.

Conventionally and preferably, so as to impart these fingers greater strength, they may be curved in crosswise direction, as seen in FIG. 5 so that the edges of the fingers are in connection with the item therein which enables a better grip and avoids sliding of the item held.

Figure 6:
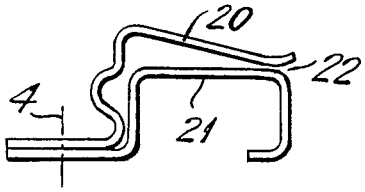
FIG. 6 is a side view of another embodiment of the springy fingers.

Finally, turning to FIG. 6, it is not always necessary to employ a pair of fingers in which pair the two fingers are of identical shape, the two in a pair being positioned symmetrically on the base. In fact there are cases—e.g. when the articles to be held and stored are of slender shape, such as wrenches or the like—in which a pair of fingers is used as shown by way of example in FIG. 6. Here, the finger 20 is substantially the same as already described, but the complementary member 21 faces the finger 20 with a straight portion, thus the space enclosed between finger 20 and member 21 being rather narrow and the entry into that space, at 22 being even narrower. The passage at the entry 22 permits the insertion of the shank of a wrench or a like relatively thin part which is then accommodated in the space between 20 and 21, the entry 22 having been forced open by the passage of the respective article and snapping shut after passage.

Reference is made to disclosure document Ser. No. 495,427 filed on May 17, 1983 by the present applicant, and the same is incorporated herein by reference.

I claim:

1. A device for holding and storing articles, such as tools and vendable items exhibited for sale, said device comprising an elongated ruler-like member having a front side and a rear side with an at least laterally enclosed space between the front side and the rear side and including an elongated rail forming the front side and having a front face and a rear face and a pair of laterally spaced elongated edges extending in the elongated direction of said rail, wall means extending from the rear face of said rail and forming the lateral closure of said laterally enclosed space said rail being recessed laterally inwardly from said elongated edges toward the rear side of said ruler-like member and with the recess extending in the elongated direction of said rail, said recess having a base spaced inwardly from said front face and an elongated slot in said base extending in the elongated direction of said rail with said slot being open between said first face and said rear face and having a front face side and a rear face side, said slot opening into said laterally enclosed space, said recess being stepped inwardly from said front face toward the base of said recess with said base forming at least one support surface stepped inwardly from said front face and disposed in substantially parallel relation with said front face, said slot dividing said support surface into a pair of co-extensive partial support surfaces, at least one pair of springy fingers being slidably mounted in said slot for holding an item therebetween, said two fingers in said at least one pair being separate from one another and being separately slidable in said slot along said support surface relative to one another so that an article can be held between said fingers, each said finger having a first end and a second end with a major extension thereof extending from said first end toward the second end and with a bent-off portion extending from said second end and being bent off at a substantially right angle relative to said major extension of said finger at a location spaced from said first end, said bent-off portion being supported on said partial support surfaces and spanning said slot, a co-acting male screw member and female screw member fixing each said finger to said ruler-like member at any desired position along said slot, said male screw member extending through said bent-off portion of said finger and through said slot with one end of said male screw member located on the front face side of said slot and the other end located on the rear face side of said slot in said laterally enclosed space, said female screw member being mounted on said male screw member and being insertable through said slot from said front side so that said female screw member can be displaced within said laterally enclosed space relative to said rear face for securing said male screw member in said slot so that said finger does not slide relative to said partial support surface, and said female screw member is a plate-shaped nut having a first dimension and a second dimension extending approximately normal to said first dimension, said first dimension being greater than the width of said slot and the second dimension being less than the width of said slot so that with the first dimension extending in the elongated direction of said slot said female screw member can be inserted through said slot from said front face to said rear face extending into said laterally enclosed space, said wall means comprises a pair of parallel flanges each located along a different one of the elongated edges of said rail and extending generally perpendicularly outwardly from said rear face, said flanges having facing surfaces defining said laterally enclosed spaces and the first dimension of said female screw member being greater than the dimension between the facing surfaces of said flanges.

2. A device according to claim 1, wherein said fingers are made of flat inherently springy steel strips, and said major extensions of said fingers have an undulating curved configuration.

3. The device according to claim 1, wherein said fingers are made of arcuately shaped lengths of material.

4. The device according to claim 1, wherein the two fingers in each said pair have an identical configuration.

5. The device according to claim 1, wherein the pair of springy fingers comprises a finger of flat inherently springy material and a complementary member which includes a straight portion which portion faces said springy finger.

6. The device of claim 1, wherein said elongated ruler like member is stamped of sheet metal.

7. The device of claim 1, wherein said elongated ruler like member is an extruded profile.

8. A device according to claim 6 or claim 7, wherein said elongated recess is provided in said front face of said elongated ruler like member with said base of said recess being spaced outwardly from said rear face.

* * * * *